US010337181B2

(12) United States Patent
Veros et al.

(10) Patent No.: US 10,337,181 B2
(45) Date of Patent: Jul. 2, 2019

(54) TOILET USAGE SENSING SYSTEM

(71) Applicant: DELTA FAUCET COMPANY, Indianapolis, IN (US)

(72) Inventors: Michael J. Veros, Carmel, IN (US); Joel D. Sawaski, Indianapolis, IN (US)

(73) Assignee: Delta Faucet Company, Indianapolis, IN (US)

( * ) Notice: Subject to any disclaimer, the term of this patent is extended or adjusted under 35 U.S.C. 154(b) by 346 days.

(21) Appl. No.: 14/949,167

(22) Filed: Nov. 23, 2015

(65) Prior Publication Data

US 2016/0145844 A1 May 26, 2016

Related U.S. Application Data

(60) Provisional application No. 62/083,599, filed on Nov. 24, 2014.

(51) Int. Cl.
*E03D 5/10* (2006.01)
*E03D 9/052* (2006.01)

(52) U.S. Cl.
CPC ..... *E03D 5/105* (2013.01); *E03D 9/052* (2013.01)

(58) Field of Classification Search
CPC ..... E03D 5/105
USPC ..... 4/313
See application file for complete search history.

(56) References Cited

U.S. PATENT DOCUMENTS 2,297,935 A 10/1942 Baither
3,763,505 A 10/1973 Zimmerman
3,817,279 A 6/1974 Larson
3,817,489 A 6/1974 Caron et al.
4,230,145 A 10/1980 Badders
4,756,031 A 7/1988 Barrett
4,832,310 A 5/1989 Nestich
5,319,809 A 6/1994 Testa
6,279,173 B1 8/2001 Kobayashi et al.
6,694,534 B2 2/2004 Stone
6,802,084 B2 * 10/2004 Ghertner ..... E03D 1/00 340/605
6,983,491 B2 1/2006 Curtis et al.
7,275,271 B1 10/2007 Smith
7,823,227 B2 11/2010 Damianoe et al.
8,069,501 B2 6/2011 Casson et al.
8,332,969 B2 12/2012 Spadola et al.
8,510,872 B2 8/2013 Muhlhausen et al.
8,555,427 B2 10/2013 Stauber et al.
2004/0040076 A1 * 3/2004 Han ..... E03D 1/34 4/300
2006/0244466 A1 11/2006 Call et al.
2010/0205727 A1 8/2010 Muhlhausen et al.
2010/0205728 A1 8/2010 Muhlhausen et al.
2010/0205729 A1 8/2010 Muhlhausen et al.
2010/0205730 A1 8/2010 Muhlhausen et al.
2010/0205731 A1 8/2010 Muhlhausen et al.
2011/0088156 A1 * 4/2011 White ..... E03D 9/052 4/348

(Continued)

FOREIGN PATENT DOCUMENTS

CA 2902465 10/2014
WO 2013138483 9/2013

*Primary Examiner* — Christine J Skubinna
(74) *Attorney, Agent, or Firm* — Faegre Baker Daniels LLP

(57) ABSTRACT

An actuation system for a toilet including a capacitive sensor received within a toilet tank and including an electrode electrically coupled with water within the toilet tank.

28 Claims, 5 Drawing Sheets

(56) References Cited

U.S. PATENT DOCUMENTS

| | | | | |
|---|---|---|---|---|
| 2011/0209287 | A1 | 9/2011 | Call et al. | |
| 2012/0055557 | A1 | 3/2012 | Belz et al. | |
| 2013/0133131 | A1 | 5/2013 | Peng et al. | |
| 2013/0186196 | A1* | 7/2013 | Veros | G01F 23/263 73/304 C |
| 2014/0047629 | A1 | 2/2014 | Stauber et al. | |
| 2014/0053329 | A1* | 2/2014 | Schuster | E03D 1/32 4/314 |

* cited by examiner

TOILET USAGE SENSING SYSTEM

CROSS-REFERENCE TO RELATED APPLICATION

This application claims priority to U.S. Provisional Patent Application Ser. No. 62/083,599, filed Nov. 24, 2014, the disclosure of which is expressly incorporated by reference herein.

BACKGROUND AND SUMMARY OF THE INVENTION

The present invention relates generally to a sensing system configured to detect the presence and/or absence of a user proximate a toilet (e.g., supported on a toilet seat) and, more particularly, to such a sensing system that includes a capacitive sensor interfacing with a controller for operating at least one toilet operating system, such as a toilet bowl pre-wetting system, an odor removal system, and/or a flushing system.

According to an illustrative embodiment of the present disclosure, a sensing system for a toilet includes a capacitive sensor having an electrode electrically coupled with tank water received within a toilet tank, the electrode and the tank water together being configured to sense a user outside of the toilet tank. A controller is in electrical communication with the capacitive sensor. The capacitive sensor is configured to send a signal to the controller in response to sensing the user. A toilet actuator is in electrical communication with the controller. The controller is configured to actuate the toilet actuator in response to the signal from the capacitive sensor.

According to another illustrative embodiment of the present disclosure, a toilet includes a toilet bowl, a toilet tank positioned above the toilet bowl, and a seat supported by the toilet bowl. A capacitive sensor includes an electrode in fluid communication with water received within the toilet tank. A controller is in electrical communication with the capacitive sensor. The capacitive sensor is configured to send a signal to the controller.

According to a further illustrative embodiment of the present disclosure, a plumbing fixture comprises a vessel containing water, and a capacitive sensor including an electrode in fluid communication with the water received within the vessel. A controller is in electrical communication with the capacitive sensor. The capacitive sensor is configured to send a signal to the controller in response to detecting a user touching or in proximity to the vessel.

According to a further illustrative embodiment of the present disclosure, a method of controlling a toilet includes the step of providing a toilet including a toilet tank containing water for delivery to a toilet bowl. A flush valve is configured to control the flow of water from the toilet tank to the toilet bowl. The method further includes the steps of positioning a capacitive sensor within the toilet tank, the capacitive sensor including an electrode in electrical communication with the water within the toilet tank, and detecting a signal provided by the capacitive sensor. The method also includes a step of comparing a measure of the signal with a threshold to determine if a person is sitting on a toilet seat supported by the toilet bowl.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
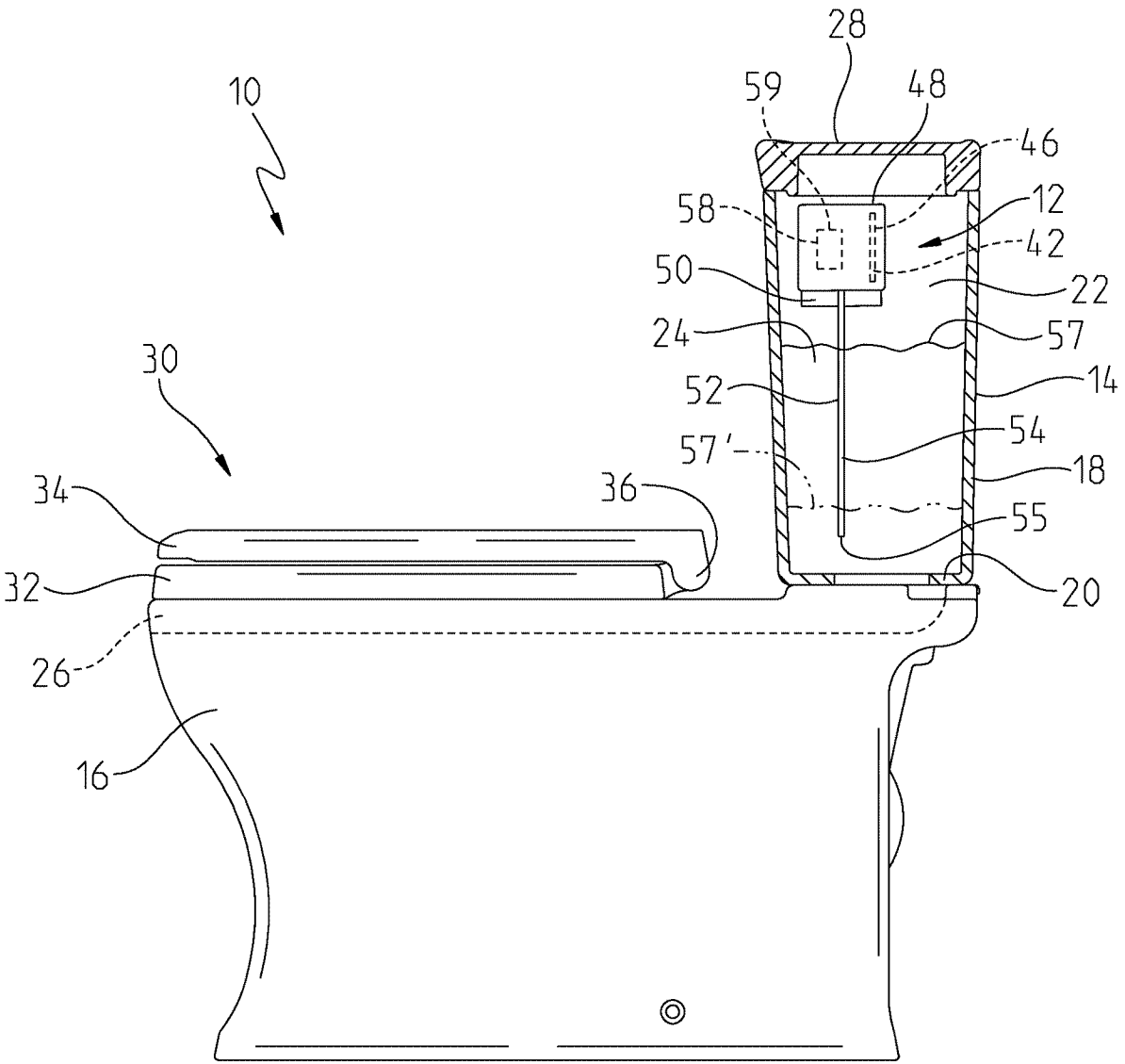
FIG. 1 is a side elevational view, in partial cross-section, of a toilet including an illustrative usage sensing system of the present disclosure.

Referring initially to FIG. 1, an illustrative toilet 10 is shown as including a usage sensing system 12, and a toilet tank 14 supported by a toilet bowl 16. More particularly, the illustrative toilet tank 14 includes side walls 18 and a bottom wall 20 defining a chamber 22 and is fluidly coupled to the toilet bowl 16. The toilet tank 14 is configured to supply tank water 24 from the chamber 22 to a rim 26 of the toilet bowl 16. Water 24 may be supplied to the tank 14 from a conventional water source through a fill valve (not shown). A tank cover 28 is illustratively supported by an upper end of the tank 14. Illustratively, the tank 14, the bowl 16 and the cover 28 are formed of vitreous china or porcelain.

A seat assembly 30 is illustratively supported above the toilet bowl 16, and may include a toilet seat 32 and a toilet lid 34 supported above the seat 32. More particularly, a hinge 36 pivotally couples the toilet seat 32 and the toilet lid 34 to the toilet bowl 16. The toilet seat 32 may be molded from a polymer.

In the illustrative toilet 10, a capacitive sensor 42 is used to determine whether a user is within a detection zone 44 proximate to the toilet tank 14 (e.g., seated on the toilet seat 32). Illustratively, the zone 44 is directed above the seat 32 and in front of the tank 14. The capacitive sensor 42 is received within the chamber 22 of the toilet tank 14 and utilizes the tank water 24 as part of the sensing system 12. Such an arrangement reduces cost and avoids the potentially unpleasant aesthetic impact of infrared sensors, mechanical seat switches and/or alternate positioning of capacitive sensors.

The capacitive sensor 42 is illustratively supported on a printed circuit board (PCB) 46 received within a housing 48. The housing 48 is illustratively positioned within the chamber 22 of the toilet tank 14, and may be coupled to an upper end of the side wall 18 of the tank 14 through a bracket 50. An electrode 52 is in electrical communication with the capacitive sensor 42 and illustratively comprises an electrically conductive wire 54 (formed of an electrically conductive material, such as metal) extending downwardly from the housing 48 and into the tank water 24. More particularly, a lower end 55 of the wire 54 is illustratively positioned below the upper surface 57 of the water 24. As such, the water 24 is directly electrically coupled to the electrode 52. The wire 54 may be of sufficient diameter to be substantially rigid and thereby remain stable in response to water flow as the toilet flushes and refills the tank 14.

While rigid wire 54 is illustratively used as the electrode 52, other electrically conductive members may be substituted therefor. The electrode 52 can comprise anything that is conductive and electrically couples the capacitive sensor 42 to the tank water 24. For example, the electrode 52 can comprise a metal rod, post or bolt. Additionally, the electrical coupling between the water 24 and the electrode 52 may be through a direct electrical coupling (i.e., in direct contact with the tank water 24) or through a capacitive coupling (i.e., via an intermediate electrical coupler, such as insulation or a cover around the outer surface of the metal wire 54).

The capacitive sensor 42 is illustratively in electrical communication with a controller 56, which may include a microprocessor coupled to a memory (not shown). In certain illustrative embodiments, the capacitive sensor 42 is integrated with the controller 56 on printed circuit board (PCB) 46. As detailed herein, the wire 54 from capacitive sensor 42 is electrically coupled to the water 24 contained within the toilet tank 14. Because the capacitive sensing area provided by the water 24 is greater than the capacitive sensing area provided by the electrode 52 alone, the capacitive sensor 42 is capable of detecting the presence of a user proximate the toilet tank 14 (e.g., seated on the toilet seat 32) at a relatively large distance from the sensor 42, with the signal to noise ratio being adequate for stability.

Because the controller 56 measures the capacitance of the tank water 24, it also detects a user coming within proximity of the water 24 (or tank 14). The large surface area of the water 24 allows the controller 56 to detect someone (e.g., a person's back—also a relatively large area) when relatively far away from the tank 14 (but still within the detection zone 44). The controller 56 may then infer that a user is seated on the toilet seat 32. The detection zone 44 illustratively comprises a three dimensional zone, extending horizontally in front of the tank 14 and vertically from proximate the seat 32 to the tank cover 28. It should be appreciated that the detection zone 44 may further extend around all outer surfaces of the tank 14.

Software in the controller 56 illustratively looks for the presence within the detection zone 44 for a minimum time (e.g., 5 sec) so that a user incidentally passing by the tank 14 is not interpreted as a user supported on the seat 32 since all sides of the tank 14 are potential detection zones. In other illustrative embodiments, software in the controller 56 distinguishes between a user touching the tank 14 and a user coming into proximity of the tank 14.

Additionally, software in the controller 56 may distinguish different types of user touches of the tank 14 based upon the duration of the respective touches. For example, the controller 56 may characterize the touch as a "tap" if the touch duration is between 0.5 and 2.0 seconds, and may characterize the touch as an "extended touch" if the touch duration is at least 2.0 seconds. Illustratively, the controller 56 may activate various toilet components in response to a tap, but not activate these toilet components in response to an extended touch. A tap is interpreted as a deliberate activation request by the user, while an extended touch is not.

The capacitance measurement of the tank water 24 is a relative measurement between the tank water 24 and a "ground plane". When a user touches or comes in close proximity to the tank 14 (and thereby the tank water 24), the user's capacitance is being added to the system. The better the user is coupled to the ground plane, the stronger the addition to the total detected capacitance.

Figure 2:
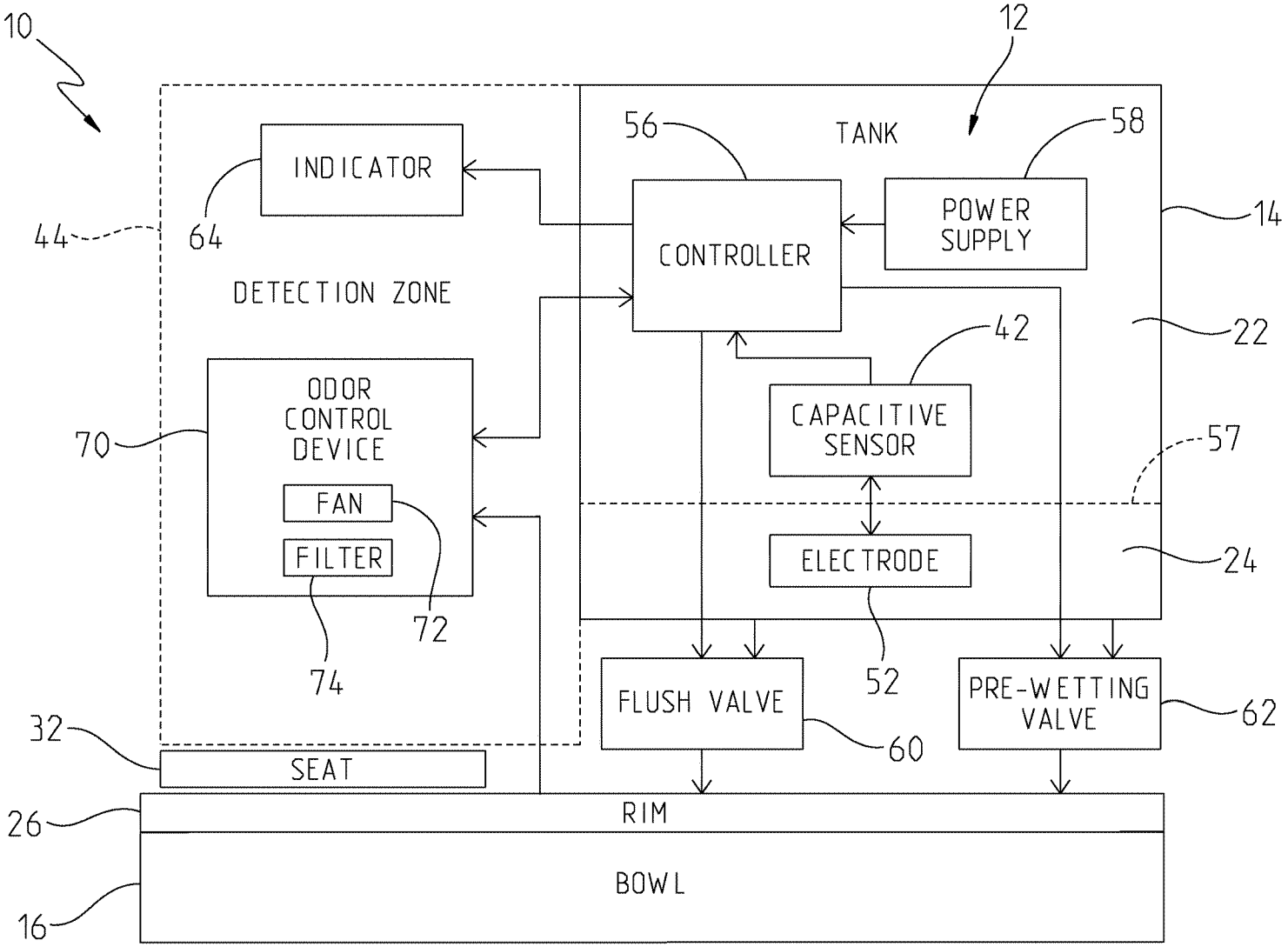
FIG. 2 is a block diagram of electrical components of the illustrative toilet of FIG. 1.

With further reference to FIG. 2, a power supply 58 is in electrical communication with the controller 56. In one illustrative embodiment, the power supply 58 comprises batteries 59 (FIG. 5) received within a sealed container positioned in the housing 48. In another illustrative embodiment, the power supply 58 comprises a direct AC connection (e.g., wires electrically coupled with a conventional wall socket).

A relationship exists between the power supply 58 (illustratively, the negative/ground terminal of the batteries 59) and the "ground plane". Using AC power as the power supply 58 provides a direct connection to ground and may improve performance. The capacitive sensor 42 is operated by the power supply 58 and is therefore in electrical communication therewith. As such, the relative position of the batteries 59 may influence readings from the capacitive sensor 42.

It is advantageous to provide vertical separation between the top 57 of the tank water 24 and the power supply 58. If the tank water 24 and the power supply 58 are too close together, the signal strength of a user coming near the tank 14 may be poor. This may be caused because essentially there is a short circuit between the water 24 and ground. As such, the user interaction will not effectively come between the water 24 and ground.

Referring further to FIG. 2, an electrically operable flush valve 60 is illustratively in electrical communication with the controller 56. The flush valve 60 controls the flow of water 24 from the tank 14 to the rim 26 of the bowl 16. The flush valve 60 may be of conventional design, and illustratively may be of the type disclosed in PCT International Patent Application Publication Number WO 2013/138483, entitled "Toilet with Overflow Protection", which is expressly incorporated herein by reference.

An electrically operable pre-wetting valve 62 is illustratively in electrical communication with the controller 56. The pre-wetting valve 62 is configured to selectively supply water 24 from the tank 14 to pre-wet the bowl 16. In one illustrative embodiment, the pre-wetting valve 62 may be the same as the flush valve 60, but operated differently (i.e., different flow volumes) by the controller 56.

An indicator 64 is illustratively supported by the tank 14 and is in electrical communication with the controller 56. The indicator 64 may comprise a visual indicator, such as a light, or an audible indicator, such as a chime or buzzer. In one illustrative embodiment, the indicator 64 may provide an indication of a low water level 57' within the tank 14. More particularly, the controller 56 may sense different signals from the capacitive sensor 42 based upon the water level 57. If the water level 57' is unexpectedly low, this could be indicative of a water leak. For example, water dropping away from the electrode 52 can be interpreted as a tank leak. More particularly, the controller 56 can sense when the water level 57 has dropped to a level where contact with the electrode 52 is lost as this causes a significant change in capacitance when the water 24 is no longer being measured. The length of the electrode 52 in an illustrative embodiment is sized so it is approximately 1 inch below the normal fill level 57 of the tank 14 to ensure strong coupling.

In other illustrative embodiments, the indicator 64 may provide an indication of different operating modes of the toilet 10. For example, the indicator 64 may illuminate with a first color (e.g., green) when the system is ready, and may illuminate with a second color (e.g., amber) when the flush valve 60 has been activated. In certain illustrative embodiments, when a user flushes the toilet 10, the controller 56 can determined that this operation has occurred because the water 24 will drop away from the electrode 52 (typical water level drop is between 2 and 3 inches). Knowledge of the flush occurring can be used to control functions further described herein. In one illustrative embodiment, the controller 56 turns off a fan 72 when a flush occurs.

An odor control device 70 is illustratively in electrical communication with the controller 56. The odor control device 70 illustratively includes electric fan 72 in fluid communication with the rim 26 of the toilet bowl 16. The fan 72 is configured to draw air from the bowl 16 through the rim 26 and into a filter 74. The filter 74 may include charcoal to remove odors from air pulled from the bowl 16.

Figure 3:
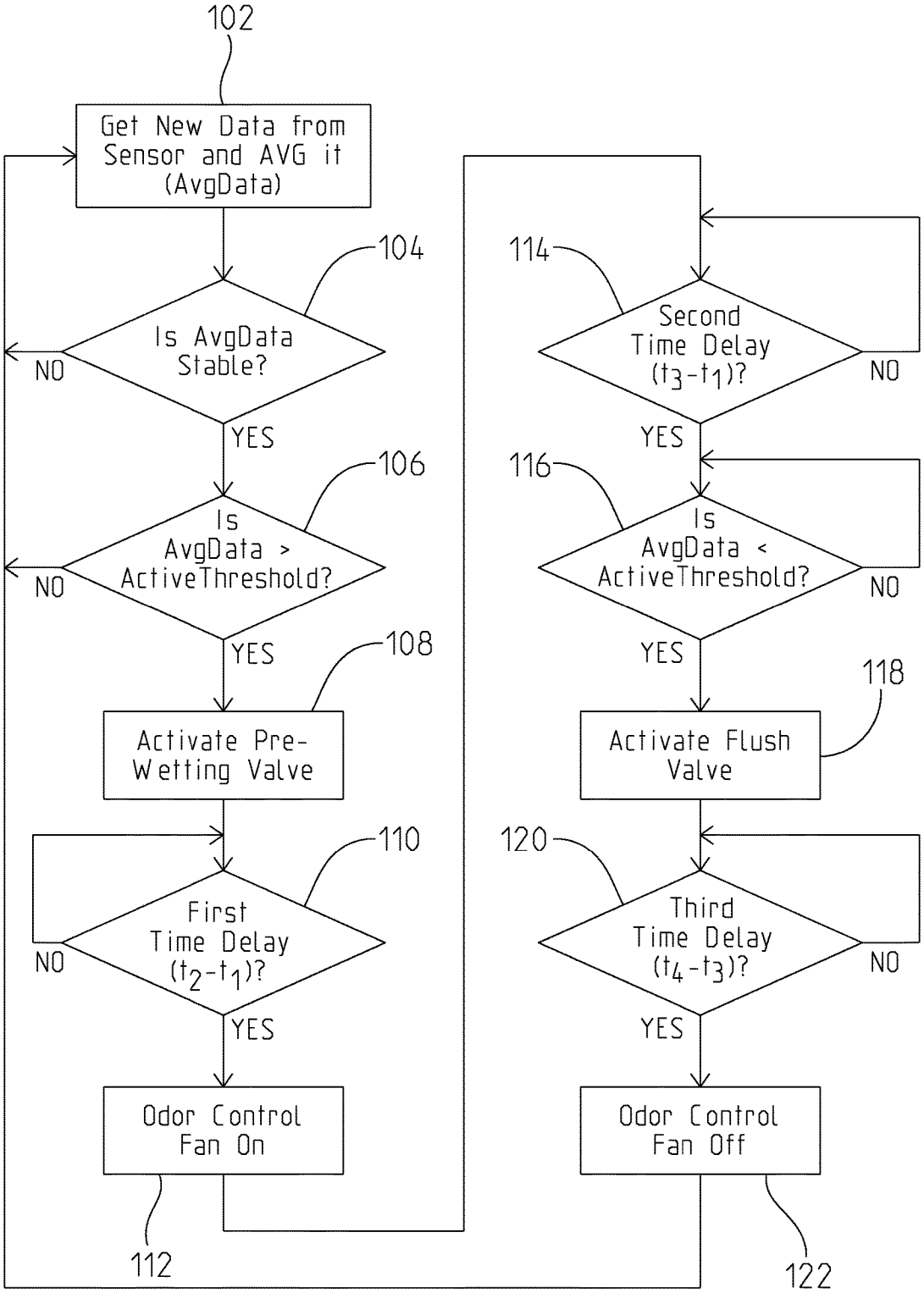
FIG. 3 is a flowchart illustrating an exemplary operation of the toilet usage sensing system of FIG. 1.
Figure 4:
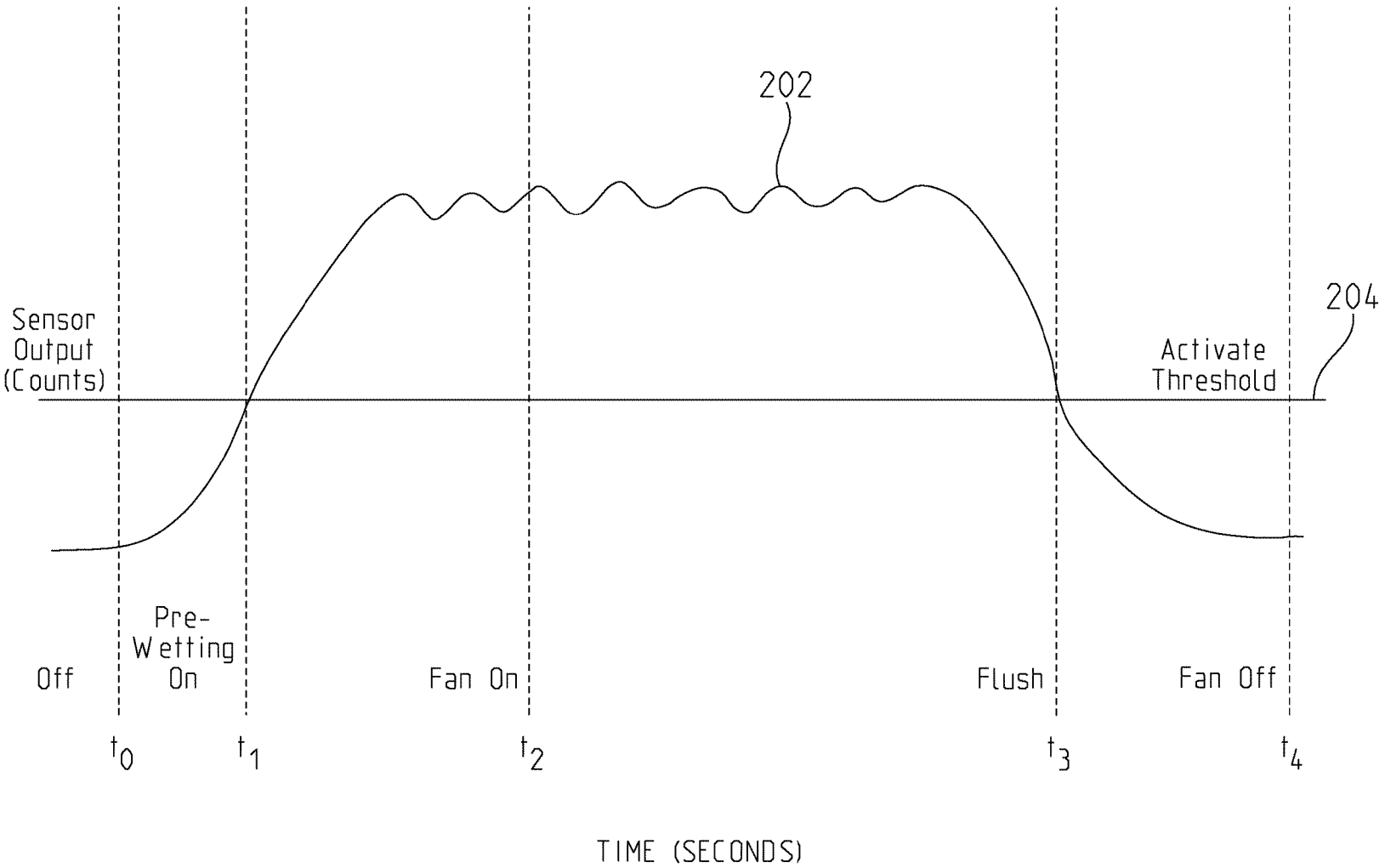
FIG. 4 is a graph of an exemplary output signal of the capacitive sensor of FIG. 1, illustrating changes in the output signal upon detecting an object in a detection zone of the toilet tank.

With reference now to FIGS. 3 and 4, an illustrative method of operating the toilet 10 is shown. At functional block 102, the controller 56 illustratively executes an algorithm provided in software stored in memory of the controller 56. More particularly, the controller 56 acquires signals from the capacitive sensor 42. The new data from the sensor 42 is illustratively averaged with previously acquired data from the capacitive sensor 42 to generate a rolling average of signal data (AvgData signal 202).

FIG. 4 illustrates representative capacitive sensing signal (AvgData signal) 202 received by the controller 56 from capacitive sensor 42. The signal 202 is plotted such that time (illustratively in seconds) is represented in the horizontal direction (X axis) and the sensor output (illustratively in counts) is represented in the vertical direction (Y axis). The active or "on" threshold of the sensor output (ActiveThreshold) is represented by line 204.

The ActiveThreshold 204 may be dynamic, for example it may vary based upon how rapid signal 202 changes over time. In other words, the controller 56 may adjust the threshold 204 based upon the rate of increase of the signal 202. More particularly, the threshold 204 is illustratively adjusted in response to a continued relatively slow rate of change of signal 202. Illustratively, environmental conditions may cause a relatively slow rate of change of signal 202, while detection of a user by capacitive sensor 42 typically causes a relatively rapid rate of change of signal 202.

At decision block 104, the controller 56 determines whether the AvgData signal 202 is stable. An illustrative method of determining capacitive sensing signal stability is disclosed in US Patent Application Publication No. 2012/0055557, entitled "Faucet including a Capacitive Based Sensor", which is expressly incorporated herein by reference.

At decision block 106, the controller 56 determines whether the AvgData signal 202 is greater than the ActiveThreshold 204. For example, at time $t_1$ in FIG. 4, the AvgData signal 202 exceeds the ActiveThreshold 204. Alternatively, a differential measurement of signal 202 at different times may be substituted for the threshold comparison at block 106.

Illustratively, the controller 56 activates the pre-wetting valve 62 at functional block 108. More particularly, at time $t_1$ the pre-wetting valve 62 causes water 24 from the tank 14 to pre-wet the bowl 16. If desired, the controller 56 may provide a time delay between time $t_1$ and when the pre-wetting valve 62 is activated.

At decision block 110, the controller 56 determines if a first time delay has been counted, illustratively the difference between time $t_2$ and time $t_1$ ($t_2-t_1$). If so, the controller 56 activates the odor control fan 72 at functional block 112. If there is no first time delay, or a different first time delay is desired, the controller 56 may be programmed to activate the odor control fan 72 at time t2, or at a different predetermined time before or after time $t_2$.

At decision block 114, the controller 56 determines if a second time delay has been counted, illustratively the difference between time $t_3$ and time $t_1$ ($t_3-t_1$). If so, the process continues to decision block 116 where the controller 56 determines if the AvgData signal 202 is less than the ActiveThreshold 204. If so, then the controller 56 activates the flush valve 60 at functional block 118. If there is no second time delay, or a different second time delay is desired, the controller 56 may be programmed to activate the flush valve 60 at time $t_3$, or at a different predetermined time before or after time $t_3$.

At decision block 120, the controller 56 determines if a third time delay has been counted, illustratively the difference between time $t_4$ and time $t_3$ ($t_4-t_3$). If so, the controller 56 deactivates the odor control fan 72 at functional block 122. If there is no third time delay, or a different third time delay is desired, the controller 56 may be programmed to deactivate the odor control fan 72 at time $t_4$, or at a different predetermined time before or after time $t_4$. The process then returns to block 102.

Referring further to the illustrative embodiment of FIG. 4, the capacitive signal 202 is below the active threshold 204 between times $t_0$ and $t_1$, indicating that an object is not detected within the detection zone 44 adjacent to the toilet seat 32 (i.e., no user supported on the toilet seat 32). As such, the controller 56 takes no action in activating various toilet systems (e.g., flush valve 60, pre-wetting valve 62, and odor control device 70). The signal 202 may be monitored by the controller 56 continuously, at certain periods, or only after certain events have occurred.

At time $t_1$, the signal 202 exceeds the active threshold 204, indicating that an object is detected within the detection zone 44 (i.e., a user is supported on the toilet seat 32). As such, the controller 56 activates a first system, illustratively the pre-wetting valve 62.

At time $t_2$, the signal 202 is still above the active threshold 204, indicating that an object is still detected within the detection zone 44 (i.e., a user is still seated on the toilet seat 32). The controller 56 then activates a second system, illustratively the fan 72 of the odor control device 70.

At time $t_3$, the signal 202 falls below the active threshold 204, indicating that an object is no longer detected within the detection zone 44 (i.e., a user is no longer supported on the toilet seat 32). The controller 56 then activates a third system, illustratively the flush valve 60. At time $t_4$, signal 202 remains below the active threshold 204 and the controller 56 deactivates the previously activated second system, illustratively the odor control fan 72.

The controller 56 may operate the toilet system(s) 60, 62, 70 detailed herein through hands-free and/or touch functionality. More particularly, the software of the controller 56 has the ability to distinguish between a user in proximity to the tank 14 and a user touching the tank 14 based upon signal strength. Touching the tank 14 provides a far greater jump in signal than a user sitting on the toilet seat 32. This occurs even though a user's hand is separated from the water 24 by the tank wall 18. The software of the controller 56 has the additional ability to distinguish between a tap, and an "extended touch" of the tank 14, as further detailed above.

Figure 5:
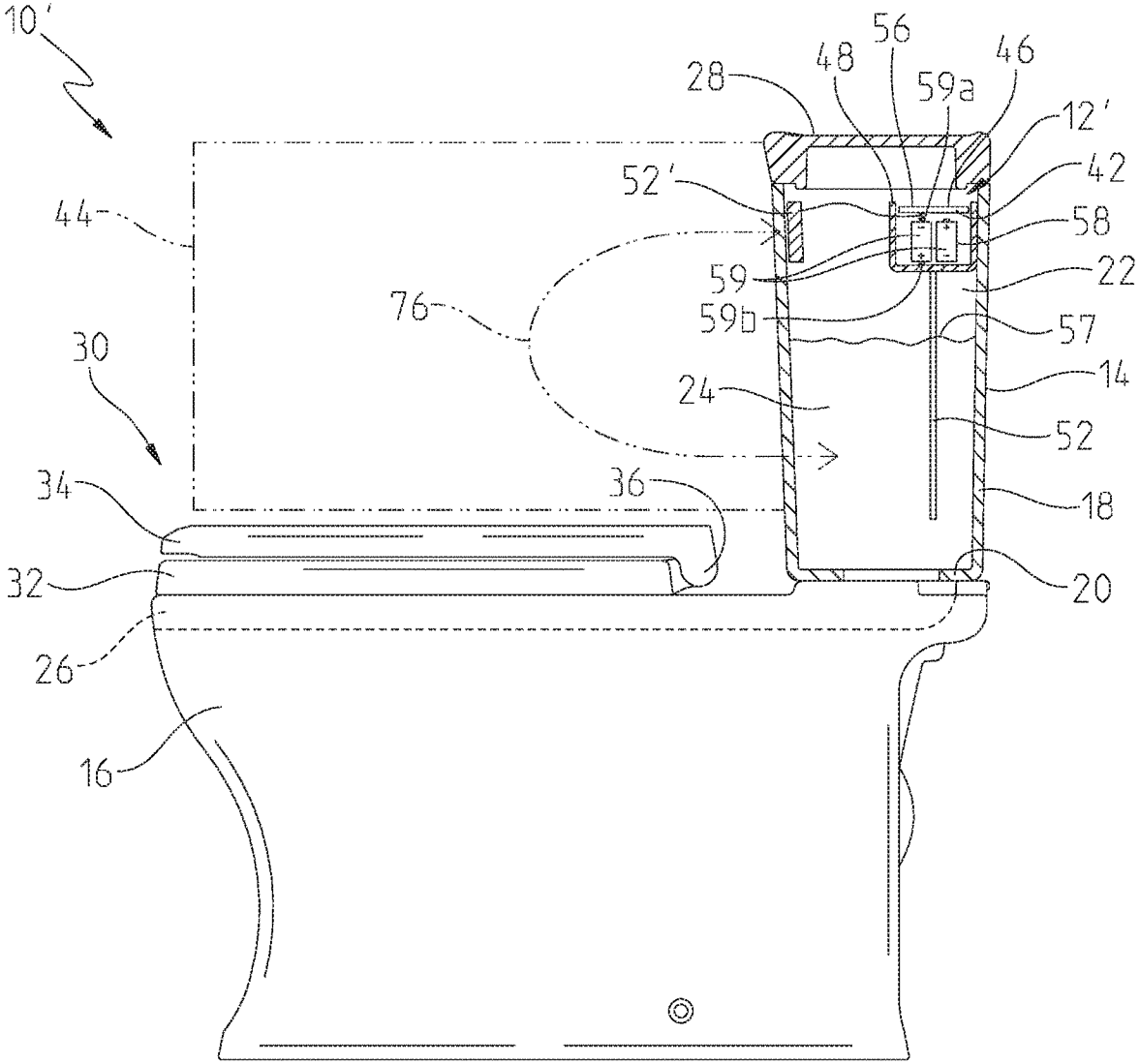
FIG. 5 is a side elevational view, in partial cross-section, of a toilet including a further illustrative usage sensing system of the present disclosure.

An introduced ground plane or second electrode 52' may be provided that enhances or supersedes the natural ground plane. FIG. 5 shows how an introduced ground plane 52' of an electrically conductive material can be placed inside the front wall 18 of the tank 14 above the water 24 and connected to a negative/ground terminal 59*a* of the batteries 59 (opposite a positive terminal 59*b*) for boosting strength of signal 202. The introduced ground plane 52' is electrically coupled (through a capacitive coupling at 76) to the tank water 24 through the tank wall 18. This arrangement improves the coupling of a user in the detection zone 44 to ground and increases the addition of the user's capacitance to that of the tank water 24. The improved signal strength provides a more stable sensing system 12' and also allows smaller sized users (e.g. children) to be detected. The introduced ground plane or second electrode 52' is illustratively used in combination with the electrode 52 detailed above in connection with FIG. 1. The introduced ground plane 52' can take many forms.

Moving the batteries 59 within the housing 48 to the front of the tank 14 helps performance, but unfortunately there may not be room to do this. Wires connecting the odor removal fan 72 to the PCB 46 can also be used. Taping these wires to the front of the tank 14 may improve performance, but the wires have very little surface area. Adding copper tape to the tank 14 and connecting it to ground substantially increases signal strength. Any small amount helps, but the larger the area, the better the performance of the sensing system 12'.

An introduced ground plane could also be added to the toilet seat 32 by making the seat 32 from an electrically conductive material, illustratively a conductive plastic. However, this may require running electrical wires outside of the tank 14.

Existing technology may use infrared sensors and/or mechanical switches built into the toilet seat 32 to detect a user supported on the seat 32. Capacitive sensing may be used, but if utilized within the toilet seat 32 or the toilet bowl 16, sensing distances are much smaller than those provided by the present invention. Such executions also require wiring to extend from the sensor location to the electronic control module or controller 56.

It should be appreciated that the sensing system 12 may be used in connection with other plumbing fixtures including chambers or vessels containing water, such as a bathtubs or sink basins. Additionally, the sensing system 12 may be used to control other systems associated within a bathroom. For example, the sensing system 12 may control operation of other plumbing related accessories, such as faucets, room fans, toilet bowl cleaning devices, and/or disinfecting systems.

Although the invention has been described in detail with reference to certain preferred embodiments, variations and modifications exist within the spirit and scope of the invention as described and defined in the following claims.

The invention claimed is:

1. An actuation system for a toilet, the system comprising:

a capacitive sensor including an electrode electrically coupled with tank water received within a toilet tank, the electrode extending into the tank water, the electrode in combination with the tank water configured to sense a user outside of the toilet tank;

a controller in electrical communication with the capacitive sensor, the capacitive sensor being configured to send a signal to the controller in response to sensing the user; and a toilet actuator in electrical communication with the controller, the controller being configured to activate the toilet actuator in response to the signal from the capacitive sensor.

2. The actuation system of claim 1, wherein the toilet actuator comprises a flush valve positioned within the toilet tank.

3. The actuation system of claim 1, wherein the toilet actuator comprises a fan in communication with a filtration device to remove odors.

4. The actuation system of claim 1, wherein the toilet actuator comprises a pre-wetting valve positioned within the toilet tank.

5. The actuation system of claim 1, wherein the electrode is formed of an electrically conductive material.

6. The actuation system of claim 5, further comprising a housing supported by the toilet tank, wherein the electrode comprises a rigid wire extending downwardly from the housing.

7. The actuation system of claim 6, further comprising a battery in electrical communication with the controller, wherein the controller and the battery are received within the housing.

8. The actuation system of claim 1, wherein the controller is configured to sense a user in proximity to the toilet tank and to sense a user touching the toilet tank.

9. The actuation system of claim 1, wherein the signal from the capacitive sensor varies based upon the water level within the toilet tank, and the controller is configured to determine a low water level based upon the signal from the capacitive sensor.

10. The actuation system of claim 1, further comprising a second electrode electrically coupled to the controller.

11. The actuation system of claim 10, further comprising a battery in electrical communication with the controller, wherein the second electrode is connected to a ground terminal of the battery.

12. The actuation system of claim 1, wherein the electrode is directly coupled to the tank water within the toilet tank.

13. The actuation system of claim 1, wherein the electrode is capacitively coupled to the tank water.

14. The actuation system of claim 1, wherein the controller defines a threshold, and the controller is configured to activate the toilet actuator when a measure of the signal from the capacitive sensor reaches the threshold.

15. A toilet comprising:

a toilet bowl;

a toilet tank positioned above the toilet bowl;

a seat supported by the toilet bowl;

a capacitive sensor including an electrode in fluid communication with water received within the toilet tank;

a detection zone extending in front of the tank and above the seat, the electrode in combination with the water in the toilet tank configured to sense a user seated on the seat within the detection zone; and a controller in electrical communication with the capacitive sensor, the capacitive sensor being configured to send a signal to the controller in response to combined sensing by the electrode and the water.

16. The toilet of claim 15, further comprising a toilet actuator in electrical communication with the controller, the controller being configured to activate the toilet actuator when a measure of the signal from the capacitive sensor reaches a threshold defined by the controller.

17. The toilet of claim 16, wherein the toilet actuator comprises a flush valve positioned within the toilet tank.

18. The toilet of claim 16, wherein the toilet actuator comprises a fan in communication with a filtration device to remove odors.

19. The toilet of claim 16, wherein the toilet actuator comprises a pre-wetting valve positioned within the toilet tank.

20. The toilet of claim 15, further comprising a housing supported by the toilet tank, wherein the electrode comprises a rigid wire extending downwardly from the housing.

21. The toilet of claim 20, wherein the controller is received within the housing.

22. The toilet of claim 21, further comprising a battery in electrical communication with the controller and received within the housing.

23. The toilet of claim 15, wherein the controller is configured to sense a user in proximity to the toilet tank and to sense a user touching the toilet tank.

24. The toilet of claim 15, wherein the signal from the capacitive sensor varies based upon the water level within the toilet tank, and the controller is configured to determine a low water level based upon the signal from the capacitive sensor.

25. A method of controlling a toilet, the method comprising the steps of:

providing a toilet including a toilet tank containing water for delivery to a toilet bowl, a toilet seat supported by the toilet bowl, and a flush valve configured to control the flow of water from the toilet tank to the toilet bowl;

positioning a capacitive sensor within the toilet tank, the capacitive sensor including an electrode in fluid communication with the water within the toilet tank, the electrode in combination with the water within the toilet tank configured to sense a person seated on the toilet seat within a detection zone;

providing a controller in electrical communication with the capacitive sensor;

detecting via the controller a signal provided by the capacitive sensor in response to combined sensing by the electrode and the water;

comparing via a controller, a measure of the signal with a threshold to determine if the person is sitting on the toilet seat supported by the toilet bowl.

26. The method of claim 25, further comprising the step of activating the flush valve in response to the signal being above the threshold for a predetermined time, followed by the signal being below the threshold.

27. The method of claim 25, further comprising the step of activating a fan of an odor control system in response to the signal being above the threshold.

28. The method of claim 25, further comprising the step of deactivating the fan of the odor control system in response to the signal being below the threshold.

* * * * *